US006149557A

United States Patent [19]

Williams et al.

[11] Patent Number: 6,149,557

[45] Date of Patent: Nov. 21, 2000

[54] SOFT SHOULDER WEIGHT DEVICE

[76] Inventors: Lynn E. Williams; Wayne G. Williams, both of P.O. Box 940, El Dorado, Tex. 76936

[21] Appl. No.: 08/948,181

[22] Filed: Oct. 9, 1997

[51] Int. Cl.[7] ..... A63B 21/065

[52] U.S. Cl. ..... 482/105; 482/93; 482/105; D21/680; D21/683

[58] Field of Search ..... 482/93, 105; D21/680, D21/683

[56] References Cited

U.S. PATENT DOCUMENTS

| | | | |
|---|---|---|---|
| D. 368,125 | 3/1996 | Wiseman | D21/680 |
| 3,111,317 | 11/1963 | Cituk | 482/105 |
| 3,784,085 | 1/1974 | Kilgore | 229/55 |
| 4,332,379 | 6/1982 | Bannister | 482/105 |
| 4,357,009 | 11/1982 | Baker | 482/105 |
| 4,407,497 | 10/1983 | Gracie | 482/105 |
| 4,846,464 | 7/1989 | Jorno . | |
| 4,891,501 | 1/1990 | Lipton | 219/527 |
| 5,167,600 | 12/1992 | Baird | 482/105 |
| 5,169,371 | 12/1992 | Holmes | 482/105 |
| 5,233,779 | 8/1993 | Shaw | 42/94 |
| 5,242,348 | 9/1993 | Bates | 482/105 |
| 5,299,999 | 4/1994 | Brine | 482/105 |
| 5,332,185 | 7/1994 | Walker | 248/346 |
| 5,417,635 | 5/1995 | Sell | 482/105 |
| 5,529,556 | 6/1996 | Segarra | 482/74 |

*Primary Examiner*—John Mulcahy
*Attorney, Agent, or Firm*—Jenkens & Gilchrist

[57] ABSTRACT

A soft shoulder weight device comprises an elongated weight bag having a first and second end which rests on the user's chest; the bag is formed from a flexible covering material sewn and shaped to fit across the shoulders and filled with ballast which migrates within the bag to accommodate the physiological make-up of the user. Another embodiment of the invention comprises two elongated weight bags, each of which rides on the shoulders of the user, one end of each bag resting on the chest of the user and the other end resting on the shoulder blades of the user. Each of the bags contains its own ballast, which migrates within the bag according to the physiological make-up of the user. The soft shoulder weight device is inherently self-padding, and additional features of the invention include pockets for the addition of solid weight elements, closures for providing access to the ballast material, and a liner used to provide additional security and complete containment of the ballast material. The soft shoulder weight device is inexpensive to make, portable, and is safer to use than commonly available exercise devices.

17 Claims, 6 Drawing Sheets

SOFT SHOULDER WEIGHT DEVICE

BACKGROUND OF THE INVENTION

1. Technical Field

The invention relates to an exercise device which accommodates a variety of exercise programs, and more particularly, to an exercise device which can be placed comfortably on the shoulders of the user and is shaped and sized to accommodate various body types, amounts of weight, and needs of exercise participants.

2. History of Related Art

The prior art in the field of exercise devices consists of free weights, hand-held weights and weight machines. More recently, weights which can be attached to the wrists and ankles have been used.

Stationery machines and free weights provide a wide range of different weight combinations and allow the user to personalize the amount of weight used to build muscle. However, both machines and free weights are cumbersome, and do not allow the user freedom to exercise away from the location where the machines and free weights are kept. Hand-held weights and attachable wrist/ankle weights provide freedom for the user during walking exercises and away from home; e.g., during travel. However, these mobile muscle building devices do not provide a wide range of weight combinations, or sufficient amounts of weight needed for substantial muscle building, as is available from the previously mentioned weight machines and free weights. A muscle building weight apparatus which provides the ability to use a wide range of weight combinations, including enough weight for substantial muscle building, and also allows easy transportation to various locations is a desirable innovation for those who wish to exercise both at home and during travel. In addition, most of the prior art devices are ungainly, unsightly, and dangerous when dropped, or during equipment failure. It would also be desirable to develop weights which are aesthetically pleasing, soft and non-dangerous to the user, and upon failure, do not present any significant danger.

Prior art devices, especially machines, are also quite expensive. Precision parts and fail-safe mechanisms must be manufactured to ensure practical and long-wearing use. It would also be useful to provide weights which are inexpensive to manufacture and require no special maintenance or concern with fail-safe mechanisms.

Free weights, including barbells, are painful to users when placed across the back of the neck and shoulders, and can be dangerous to surrounding people and objects when dropped, or when the user turns. Dumbbells do not distribute the weight through the torso and depend on arm strength that may not allow the use of enough weight to properly stress the large leg and back muscles to be exercised. Dumbbells also can not be comfortably placed on the shoulders. Backpacks and vests may allow the addition of weight for large muscle exercise, but are difficult to get into and out of for beginning trainers, and are also awkward to store. In addition, most free weights are noisy, and dangerous when dropped. Therefore, there is a need for exercise devices which allows weak users to place enough weight on the shoulders for properly exercising the larger muscles, while providing comfortable accommodation by the body. Further, there is a need for exercise devices which are quiet and do not fail in a catastrophic manner, or provide constant danger to those located near to the user.

Another difficulty with prior art devices is that they are not easily adapted for use by those persons living in smaller spaces, such as mobile homes or efficiency apartments, and those persons confined to wheelchairs. In the case of mobile home or apartment dwellers, weight machines usually are too bulky to be practical, and free weights, when dropped, may cause substantial damage to the flooring structure. Wheelchair occupants are not able to balance a weight bar on their shoulders when using a walker in front of them for leg exercises (e.g. grabbing on to the walker and rising out of the wheelchair), and any type of backpack device is uncomfortable to wear while seated, as well as difficult to apply to the wearer. Therefore, it is desirable to provide an exercise device which lends itself to use in confined spaces, distributes impact force over a large area when dropped, and can be comfortably applied and worn by wheelchair occupants for developing leg muscles and other large muscle groups.

SUMMARY OF THE INVENTION

In accord with solving the deficiencies presented by the prior art, the invention provides a soft, flexible exercise device which can be comfortably placed across the shoulders to exercise large muscles in the body. These weights can be used in a resistant weight exercise program which includes squats, lunges, stand-ups, sit-downs, toe raises, and multiple upper-body exercises, such as overhead presses, rows, arm raises, bicep curls, shoulder shrugs, and waist whittlers, etc. One embodiment of the invention comprises an elongated weight bag comprising a soft and flexible covering material which is sewn and shaped so as to fit comfortably across the shoulders and around the neck. The bag is designed to completely contain ballast, such as sand or lead/steel shot, or any other relatively dense particulate material, which is allowed to flow freely from the front to the back of the weight bag. That is, with the exception of shaping seams, the ballast is allowed to move within the bag so as to provide a more comfortable fit and adapt to the needs of various exercise participants and particular exercises. Closures, such as zippers, can be used to provide access to the ballast for adjustment of the total amount contained within the weight bag of the instant invention. In addition, a liner can be placed within the outer covering material to provide additional security against leakage of the ballast into the environment surrounding the weight bag. The instant invention readily lends itself to use by those who occupy smaller living areas, such as efficiency apartments and mobile homes, being compact, easily stored, relatively safe, and aesthetically pleasing, in contrast to commonly available weight machines and other bulky exercise devices.

The soft shoulder weight device of the present invention is inherently safe in the preferred embodiment, having no sharp corners. Dropping the soft shoulder weight device will usually not result in any damage to flooring, as may easily occur with commonly available free weights, since the weight of the ballast is more evenly distributed over a large area. Since the soft shoulder weights do not roll across the floor, as do commonly available free weights, they are safer for use in home with infants. In addition, any type of failure will normally result in the slow release of the ballast, and not physical injury, as for free weights on bars, or exercise machines.

Because of their construction, the weights of the present invention are self-padding, distributing the weight of the ballast evenly across the body of the wearer, medically efficient, fit snugly on the shoulders and around the neck, and are easy to grasp and lift. Wheelchair occupants can also use the present invention as part of an exercise program which results in substantial benefits, since the invention will rest comfortably on the shoulders and allow the wearer to raise and lower themselves by using a walker (or other stable device) placed in front of the wheelchair. The invention is also cost-effective, avoids bruising, and can be made to fit different body types.

Alternative embodiments of the instant invention provide pockets for the addition of solid weight elements, and auxiliary padding as needed to suit particular exercise participants. These weights can be easily carried in a suitcase for use during travel and are ideally suited for elderly persons who may not have the strength to lift commonly available free weights over their head. Another embodiment of the invention dispenses with particulate ballast entirely, and relies on the use of pockets alone for accommodating solid weight elements.

Finally, the instant invention provides a soft shoulder weight device which conforms to the body of the user in a comfortable way. It can be made in a variety of appealing fabrics and colors that are aesthetically pleasing. Because there are no sharp comers in the preferred embodiment, use of the weights are unlikely to break glass table tops, toes, or other objects if dropped or swung. In addition, the weight bags are designed so that the ballast within can be distributed proportionally, as desired. For instance, a person who has the habit of slouching forward can position the ballast toward the rear of the bag so that more weight is resting on their back, making it easier for them to correct their posture.

Because of the form-fitting, comfortable nature of the weight bags, many other applications, unsuited to conventional free weights or machines, are possible. Bedridden patients can place the weight bags on different body parts for weight-resistant training exercises. The bags can be placed on the arms, legs, or even the head to provide weighted resistance within a customized exercise program for patients with special needs. As previously mentioned, persons confined to wheelchairs can use the bags for weighted resistance during sitting and standing exercises, while holding on to a walker or other support with their hands.

DETAILED DESCRIPTION OF PRESENTLY PREFERRED EXEMPLARY EMBODIMENTS

Figure 1A:
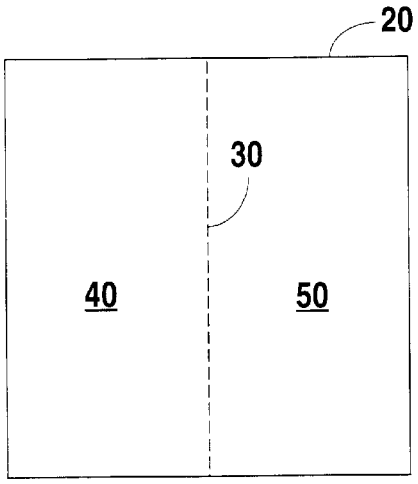
FIGS. 1A–1D detail various steps in the construction of the present invention.
Figure 1B:
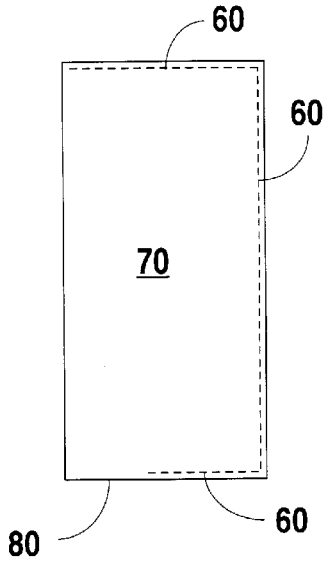

Turning now to FIGS. 1A–1D, several steps in the assembly process for the preferred invention can be seen. FIG. 1A depicts a rectangular piece of flexible covering material 20 which is divided into an outside back surface 40 and an outside front surface 50 by a fold line 30. In FIG. 1B, the outside back surface 40 has been turned over at the fold line 30 across the outside front surface 50 so that the inside back surface 70 is now visible. Inside stitching 60 is now applied around the edges of the flexible covering material 20 so as to create a compartment which is completely enclosed, with the exception of mouth 80.

Figure 1C:
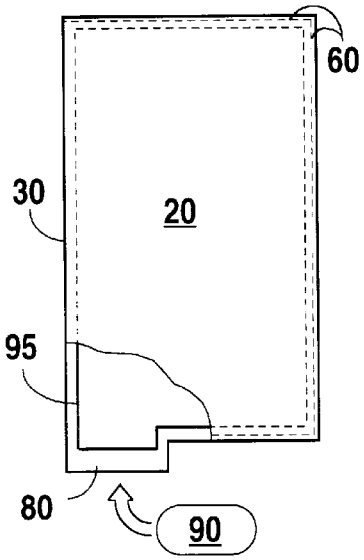
Figure 1D:
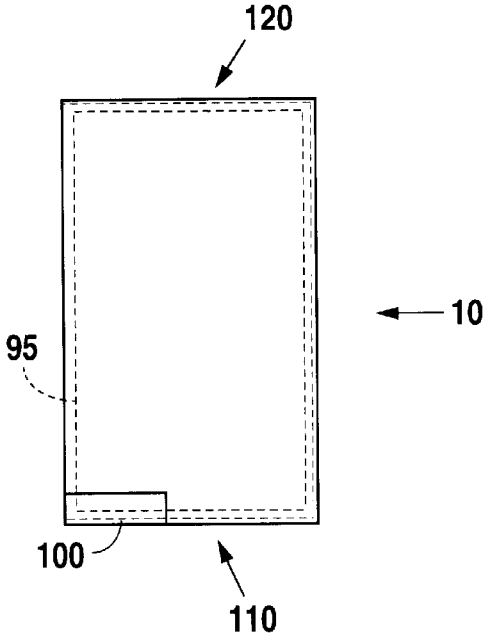

Turning now to FIG. 1C, the partially constructed device of the present invention can be seen. In this illustration, the sewn flexible covering material 20 has been turned right-side-out so that inside stitching 60 is now hidden. A liner 95 is optionally placed within the compartment formed by the sewn flexible covering material 20 and ballast 90 is then placed into the compartment. If no liner 95 is used, then the ballast 90 is placed directly within the compartment created by way of mouth 80. However, if a liner 95 is used, then the ballast 90 is placed into the liner by way of mouth 80, the liner 95 is then sealed. In either case, as shown in FIG. 1D, the elongated weight bag 10 of the present invention is completed by application of mouth stitching 100 across the opening of mouth 80. In this embodiment of the present invention, front end 110 of the elongated weight bag 10 is placed on the chest of the wearer, and the back end 120 of the elongated weight bag 10 is placed on the corresponding shoulder blade of the wearer. The main bulk of the weight bag 10 rides across the shoulder of the wearer, distributing the weight of the ballast 90 throughout the torso, and is inherently self-padding, due to the character of the ballast 90, which normally comprises sand, steel shot, or lead shot. A second weight bag 10 is then placed on the other shoulder of the user. This two-piece weight system evenly distributes the ballast weight throughout the user's torso, and requires the user to only lift half of the weight up to his shoulder at any one time.

The covering material 20 can be made from cloth, rubberized cloth, high-strength polymers, or other flexible and relatively strong/durable materials. The covering material 20 may also be selected so as to allow regular cleaning by wiping with disinfectant. The method of sealing the ballast 90 within the covering material 20 should be suited to the type of material chosen. For example, sewing, while appropriate for cloth, may not be desirable for use with polymers, which lend themselves to heated fusion. Of course, the ballast 90 can also effectively comprise any relatively dense particulate material with an individual particle size of less than about 0.5 $in^3$, and a density of greater than about 4.0 $lbs/ft^3$, and is most preferably comprised of a particulate substance which will not harm the environment or create an undue amount of messiness if it leaks out of the confines of the liner 95, or the sewn covering material 20. The chance of such leakage is substantially reduced by the use of the optional liner 95, which is preferably comprised of a durable upholstery fabric, or flexible polymer material which can be heat-sealed. Zip-lock type closures are also useful for containment of ballast 90 within liner 95 which is completely contained within the weight by 10. The present invention also anticipates that the liner 95 can be sewn closed at the same time as the covering material 20, or may be separately closed to seal in the ballast 90, before the covering material 20 is closed over it.

Figure 2A:
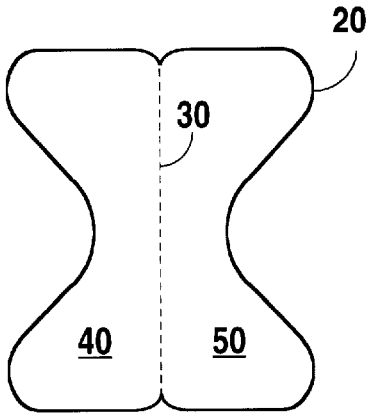
FIGS. 2A–2D detail various construction steps in alternative embodiments of the present invention.
Figure 2B:
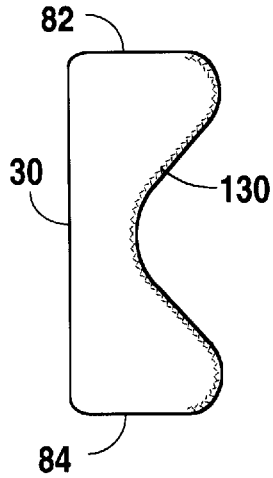

FIGS. 2A–2D depict the details of construction for two alternative embodiments of the present invention. FIG. 2A details an alternative cut-out pattern for the flexible covering material 20 which is again divided along a fold line 30 into an outside back surface 40 and an outside front surface 50. In this case, as shown in FIG. 2B, V-stitching 130 is applied over approximately 70% of the matching edges of flexible covering material 20, leaving open a top mouth 82 and a bottom mouth 84 at the ends of the material 20. Construction of the device can then be completed in one of two ways.

Figure 2C:
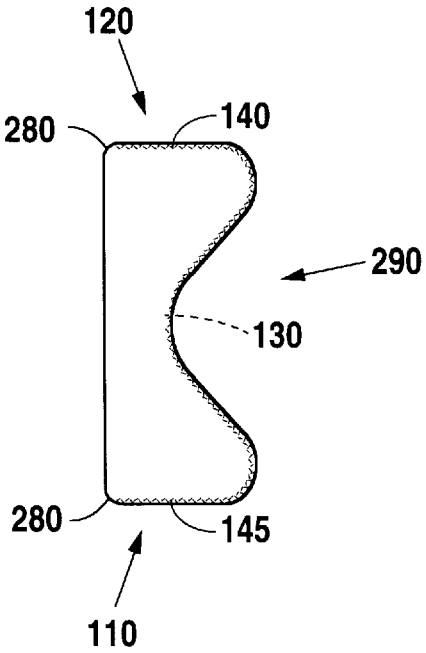

FIG. 2C details the first manner of completing construction of the device, where the application of end stitching 140 to the top mouth 82 is shown. At this time the sewn material 20 can be turned right-side-out and filled with ballast 90. Also shown is the use of rounded corners 280 throughout the device to prevent sharp edges which may poke the user or cause discomfort. Once the closure stitching 145 has been applied to the bottom mouth 84, the front end 110 and back end 120 are clearly evidenced. At this point, the K-shaped bag 290 is complete and can be used by the wearer. Most preferably, the K-shaped bag 290 is placed so that the narrow portion 135 rests snugly over the shoulders and against the neck of the wearer; the front end 110 rests on the chest of the wearer, while back end 120 rests on the corresponding shoulder-blade of the wearer. Usually, the V-stitching 130 will be placed face-down on the shoulder, and fold line 30 will face upward, but the K-shaped bag 290 can also be placed so that the V-stitching 130 faces inwardly toward the neck of the user, and the fold line 30 faces outward.

Figure 2D:
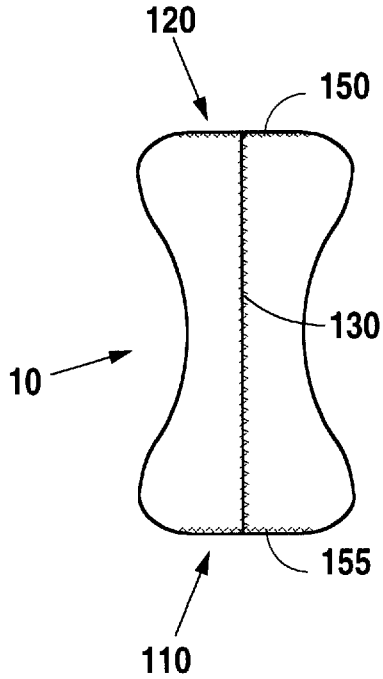

Instead of completing construction of the soft shoulder weight device of the present invention according to FIG. 2C, the method shown in FIG. 2D can also be applied. In this case, the material 20 is laid down so that fold line 30 is hidden and the V-stitching 130 is uppermost. Inside T-stitching 150 is then applied to close off the top mouth 82. The sewn material 20 is then turned right-side-out, filled with ballast 90, and then sewn across the folded bottom mouth with outside T-stitching 155. This creates a weight bag 10 which grips the shoulder more firmly than the implementation shown in FIG. 2C (i.e., K-shaped bag 290), but is preferred by some users because it distributes the weight of the ballast 90 more evenly across the chest of the user. The weight bag 10 of FIG. 2D can also be worn with V-stitching 130 facing inwardly toward the user's neck, or downwardly, directly facing the user's shoulder.

Figure 3A:
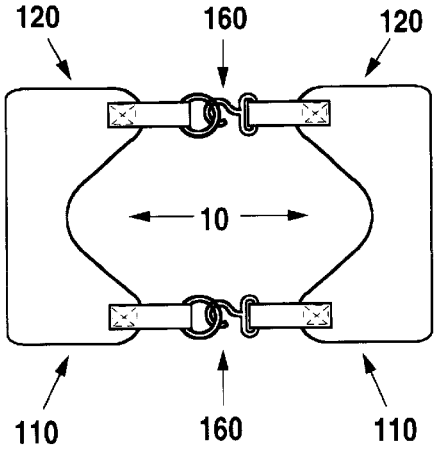
FIGS. 3A–3B illustrate various fastening mechanisms for use with the present invention.
Figure 3B:
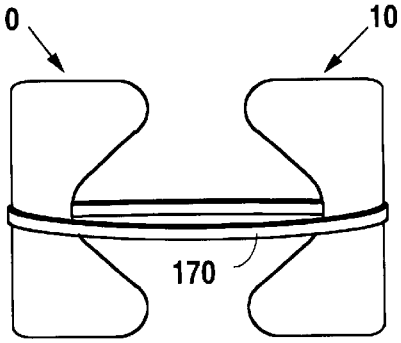

FIGS. 3A–3B depict an embodiment of the present invention which accommodates users with severely sloped shoulders. In FIG. 3A, a pair of elongated weight bags 10 are shown connected at the front ends 110 and the back ends 120 by a pair of hook and eye fasteners 160. Of course, other fasteners, such as snaps, buttons, or hook and loop material can be used to join the two bags 10 about the wearers neck. FIG. 3B illustrates the use of an elastic strap 170 to hold two of the bags 10 together as they ride on the shoulders of the user.

Figure 4A:
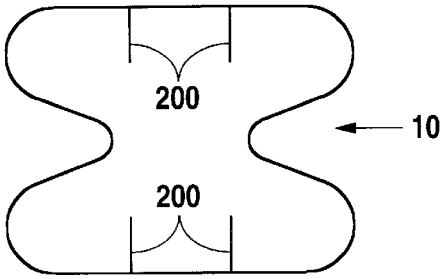
FIGS. 4A–4D illustrate alternative embodiments of the present invention.

FIGS. 4A–4D depict alternative embodiments of the present invention that demonstrate optional features which may be included to enhance the utility of the device. In FIG. 4A, shaping seams 200, which are used to flatten the hourglass-shaped weight bag 10 and serve to direct the distribution of the ballast 90 (i.e. its direction of migration) within the bag 10, can be seen. While the ballast is free to migrate within the confines of the bag 10, according to the physiological make-up of the user, it is also desirable to disperse the ballast within the bag 10 in a semi-controlled manner so as to prevent an over-accumulation of ballast in one part of the bag 10 or the other. This particular embodiment is shorter and wider than other embodiments to better accommodate persons with short torsos, women with large breasts, and obese people.

Figure 4B:
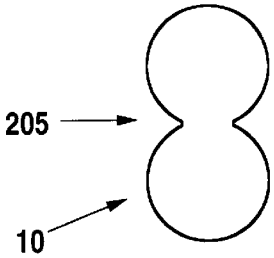

FIG. 4B depicts another embodiment of the present invention which is useful for very weak users, or those with arthritic hands. The narrow neck 205 serves to provide an hourglass-shaped weight bag 10 which is easy to pick up and place on the shoulder.

Figure 4C:
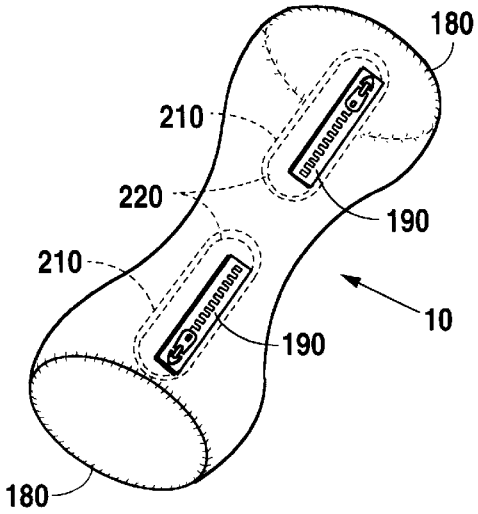

FIG. 4C depicts an hourglass-shaped weight bag 10 with both enhanced aesthetic and functional appeal. The circle stitching 180 provides a base within the weight bag 10 which can hold additional weight; the flattened, oblong shape of the resulting device is comfortable for wearing on the chest and back. The zipper closures 190 are useful for accommodating solid weight elements 220 within compartments 210. This allows the easy addition or substraction of extra weight which may be used in addition to the ballast 90 contained within the confines bag 10. Additionally, steel or lead shot may be used within the compartments 210; sand is normally not placed therein because it has a tendency to leak out of zippered closures.

Figure 4D:
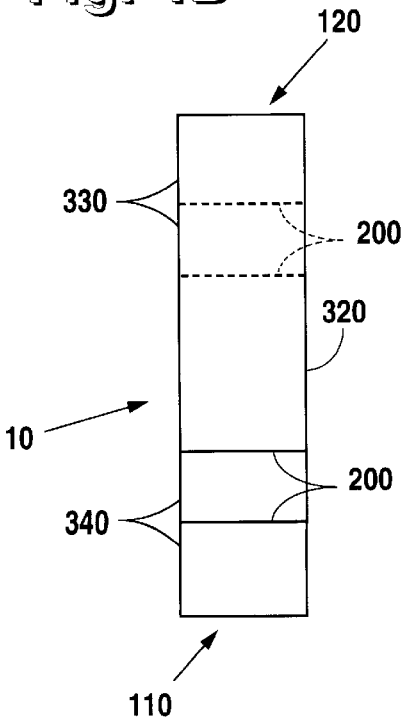

FIG. 4D illustrates further use of shaping seams 200 to distribute ballast 90 within the confines of the weight bag 10. In this case, the center section 320 of the bag 10 is filled more loosely with ballast 90, than are the front sections 340, or rear sections 330. This particular distribution of the ballast 90 allows the center section 320 to more easily accommodate users with narrow shoulders.

Figure 5A:
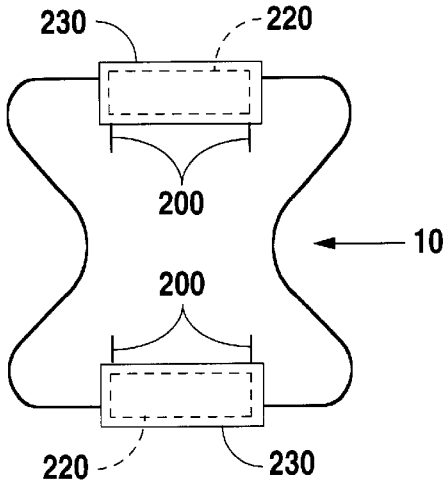
FIGS. 5A–5C illustrate alternative embodiments of the present invention having pockets to accommodate solid weight elements.
Figure 5B:
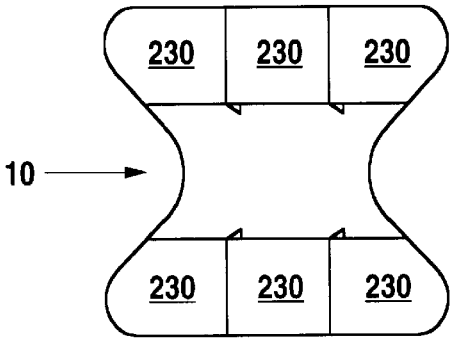
Figure 5C:
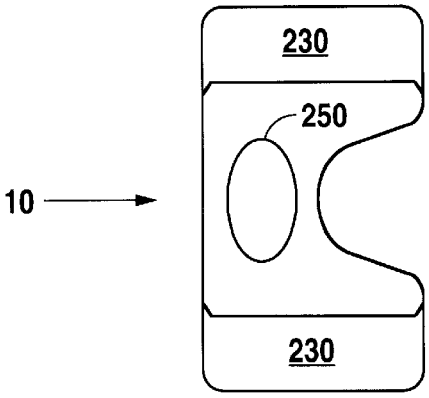

Turning now to FIGS. 5A–5C, alternative embodiments of the present invention having pockets 230 can be seen. FIG. 5A comprises the embodiment of the invention originally shown in FIG. 4A, but adds pockets 230 to the design, which may be sewn along the shaping seams 200. One or more pockets 230 are used to accommodate the addition of (or removably accommodate) solid weights elements 220 to enhance the exercise of advanced users, without adding additional length to the design. FIG. 5B depicts a series of pockets which can be added to accommodate a great deal of extra weight, if desire by the user.

FIG. 5C depicts a variation of the embodiment of the invention originally shown in FIG. 2B, with the addition of auxiliary padding 250 and pockets 230. It should be noted that any embodiment of the present invention having pockets 230 also anticipates the use of solid weight elements 220 as the exclusive source of weight, without the use of particulate ballast 90 material, when the inherently self-padded nature of the soft shoulder weight is not as important as is the ability to transport the bag 10 in its most compact form. In this case, the weight of the bag 10 is attributed entirely to solid weight elements 220, which are accommodated by pockets 230.

Figure 6A:
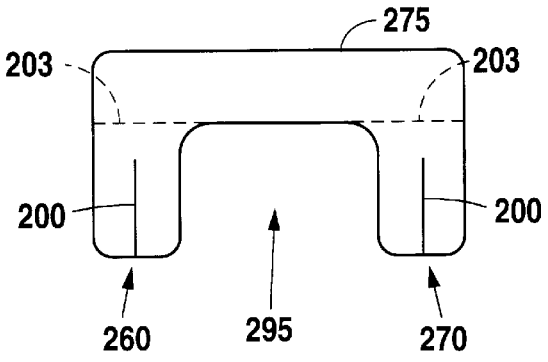
FIGS. 6A–6G illustrate alternative embodiments of the present invention.

FIGS. 6A–6E depict alternative embodiments of the invention which provide a single weight bag that rests across both of the wearer's shoulders simultaneously, and do not require two bags, one for each shoulder, as do the embodiments noted previously. FIG. 6A depicts a C-shaped bag 295 which comprises an elongated weight bag having a first end 260 and a second end 270, formed of the same flexible covering material described previously. Shaping seams 200 can also be applied to the C-shaped bag 295 to flatten the ends 260 and 270 and direct the distribution of the ballast 90 within the C-shaped bag 295. Further, optional shaping seams 203 can be applied to allow the use of two different types of ballast within the same bag 295. For example, the tube 275 created by the addition of optional shaping seams 203 can be loosely filled with sand, and the remaining area within the C-shaped bag 295 can be filled with steel shot. While this particular embodiment of the invention is very comfortable, it requires a great deal of arm strength to place the C-shaped bag 295 across the shoulders of the wearer. The length and weight of the C-shaped bag 295 are adapted to the height and strength of the wearer. This style suits advanced weight lifters and is good for tall, slim people, and barrel-chested people.

Figure 6B:
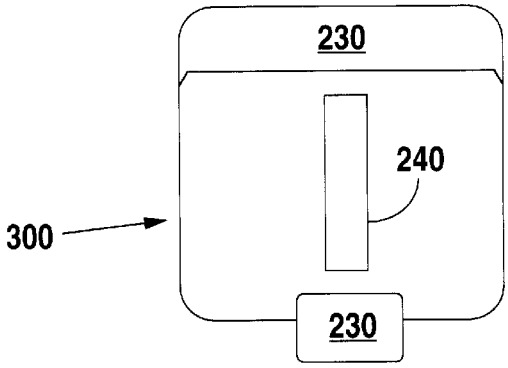

FIG. 6B is another embodiment of the invention which is most particularly suited to persons with severely sloped shoulders. The bag must be placed over the head of the wearer; the head is accommodated by head aperture 240. Pockets 230 are used to allow the addition of solid weight elements 220, if desired.

Figure 6C:
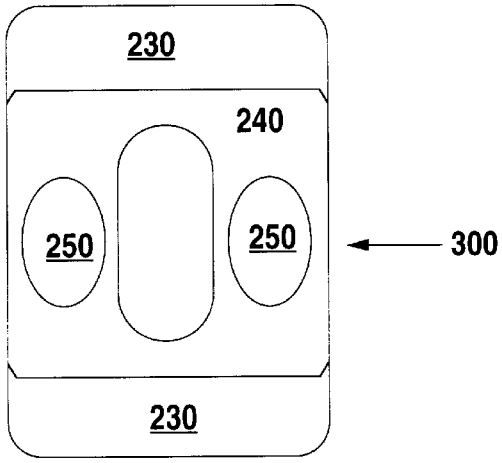
Figure 6D:
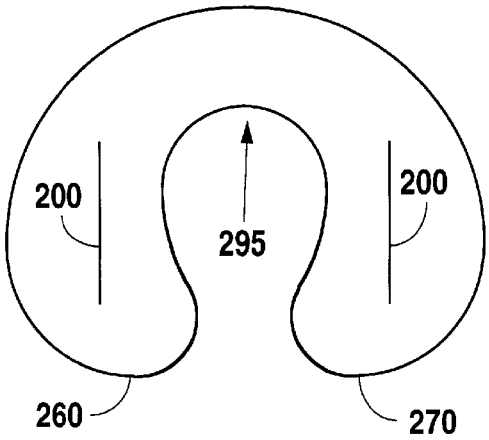
Figure 6E:
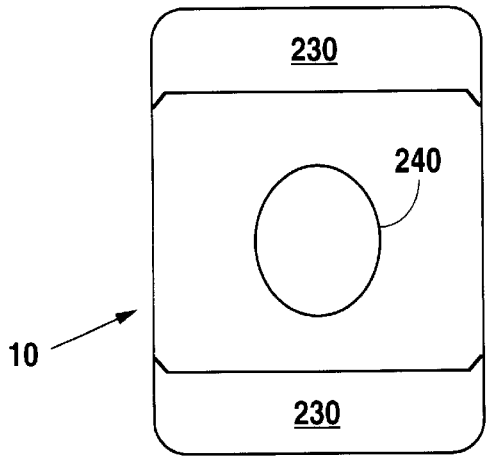
Figure 6F:
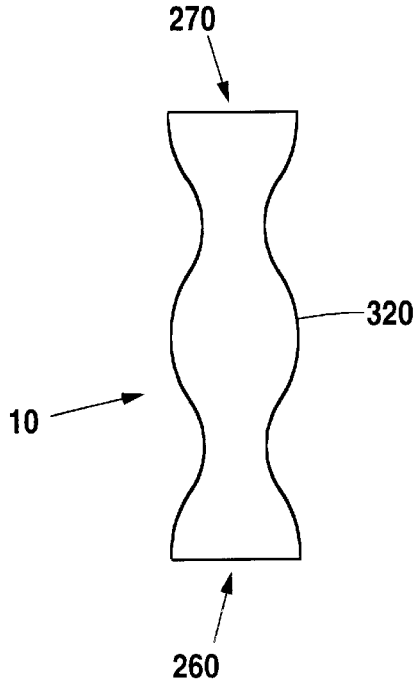
Figure 6G:
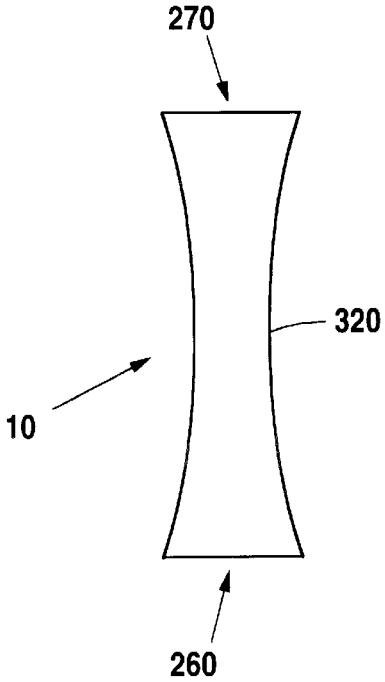

FIG. 6C depicts an embodiment of the invention which accommodates those with severely sloping shoulders, and provides the advantage of auxiliary padding 250, along with pockets 230. FIG. 6D depicts another embodiment of the invention, which can also be considered a C-shaped bag 295 that has a first end 260 and a second end 270. Shaping seams 200 can be applied to the design to flatten the ends of the bag 295 and direct the migration of the ballast within the bag 295. FIG. 6E depicts a variation of the inventive embodiment shown in FIG. 1D, adding a head aperture 240 and pockets 230. FIGS. 6F and 6G provide a single weight bag 10 that can be draped across the shoulders, with the first and second ends 260 and 270 resting on the chest, and the center section 320 fitting snugly against the back of the wearer's neck. The bags 10 are loosely filled with ballast 90 for comfortable weight distribution, and this embodiment is more useful to those users desiring lighter weight implementations of the invention.

Figure 7:
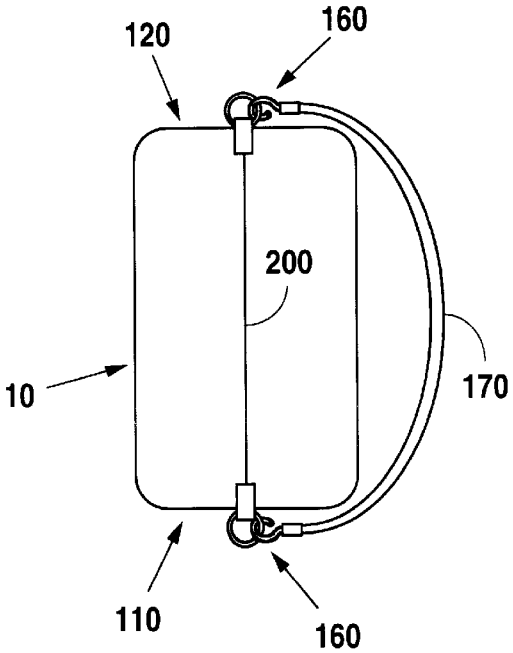
FIG. 7 illustrates an alternative embodiment of the present invention which can be used for foot exercises.

FIG. 7 depicts a variation of the invention which can be used for floor exercises. The shaping seam 200 down the center of the elongated weight bag 10 is used to guide the migration of the ballast within, and makes use of hook and eye fasteners 160, along with an elastic strap 70 to secure the bag 10 to the feet during floor exercises. Other forms of fasteners, such as buttons, snaps, and hook-loop material can be used in place of hook and eye fasteners 160.

Although the invention has been described with reference to specific embodiments, this description is not meant to be construed in a limited sense. Various modifications of the disclosed embodiments, as well as alternative embodiments of the invention, will become apparent to persons skilled in the art upon reference to the description of the invention. It is, therefore, contemplated that the appended claims will cover such modifications that fall within the scope of the invention.

What we claim is:

1. A soft shoulder weight exercise device comprising:

an elongate weight bag, said bag being K-shaped to fit across a user's shoulder with a front end thereof resting on the chest, a back end thereof resting on the shoulder blade, and an intermediate narrow portion thereof resting over the shoulder and against the neck of the user;

particulate ballast contained within said weight bag for providing resistance to exercise;

a plurality of pockets proximate the front and rear ends of said weight bag; and a plurality of solid weight elements removably contained within said pockets.

2. The soft shoulder weight device of claim 1 wherein shaping seams are used to affect the migration direction of said ballast within said bag.

3. The soft shoulder weight device of claim 1 wherein said ballast comprises particulate material having a particle size of less than about 0.5 $in^3$ and a density of more than about 4.0 $lbs/ft^3$.

4. The soft shoulder weight device of claim 1 wherein said ballast comprises sand.

5. The soft shoulder weight device of claim 1 wherein said ballast comprises steel.

6. The soft shoulder weight device of claim 1 wherein said ballast comprises lead.

7. The soft shoulder weight device of claim 1 wherein said bag further comprises a closure providing access to said ballast material.

8. The soft shoulder weight device of claim 1 wherein said bag further comprises a liner completely contained within said bag, said liner completely containing of said ballast.

9. A soft shoulder weight exercise device comprising:

a pair of elongate weight bags, each said bag being K-shaped to fit across a user's shoulder with a front end thereof resting on the chest, a back end thereof resting on the shoulder blade, and an intermediate narrow portion thereof resting over the shoulder and against the neck of the user;

particulate ballast divided into two portions, one said portion contained within each said weight bag for providing resistance to exercise;

elongate flexible members attached to the front and rear ends of each said bag, said members connecting the front ends of the weight bags together and the rear ends of said weight bags together.

10. The soft shoulder device of claim 9 wherein each of said bags has rounded corners.

11. The soft shoulder weight device of claim 9 wherein said ballast comprises particulate material having a particle size of less than about 0.5 $in^3$ and a density of more than about 4.0 $lbs/ft^3$.

12. The soft shoulder weight device of claim 9 wherein said ballast comprises sand.

13. The soft shoulder weight device of claim 9 wherein said ballast comprises steel.

14. The soft shoulder weight device of claim 9 wherein said ballast comprises lead.

15. The soft shoulder weight device of claim 9 wherein each of said bags further comprises a closure providing access to said ballast material.

16. The soft shoulder weight device of claim 9 wherein each of said bags further comprises a liner completely contained within said bag, said liner completely containing one of said portions of said ballast.

17. The soft shoulder weight device of claim 9 wherein shaping seams are used to affect the migration direction of said portions of said ballast within said bags.

* * * * *

UNITED STATES PATENT AND TRADEMARK OFFICE

CERTIFICATE OF CORRECTION

PATENT NO. : 6,149,557

DATED : Nov. 21, 2000

INVENTOR(S) : Lynn E. Williams; Wayne G. Williams

It is certified that error appears in the above-indentified patent and that said Letters Patent is hereby corrected as shown below:

Col. 1, line 4, please insert the following:

"CROSS REFERENCE TO RELATED APPLICATIONS

This application claims the benefit under Title 35 United States Code §119(e) of U.S. Provisional Application No. 60/027,694, filed on October 10, 1996, which is incorporated herein in its entirety."

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,149,557
DATED : November 21, 2000
INVENTOR(S) : Lynn E. Williams; Wayne G. Williams It is certified that error appears in the above-identified patent and that said Letters Patent is hereby corrected as shown below:

Column 1,
Line 4, please insert the following:

"CROSS REFERENCE TO RELATED APPLICATIONS

This application claims the benefit under Title 35 United States Code §5119(e) of U.S. Provisional Application No. 60/027,694, filed on October 10, 1996, which is incorporated herein in its entirety."

This certificate supersedes certificate of correction issued May 29, 2001.

Signed and Sealed this

Eighth Day of January, 2002

*Attest:*

*Attesting Officer*

JAMES E. ROGAN
*Director of the United States Patent and Trademark Office*